US012543841B2

(12) United States Patent
Zheng et al.

(10) Patent No.: US 12,543,841 B2
(45) Date of Patent: Feb. 10, 2026

(54) COSMETIC APPLICATOR INCLUDING AN ADJUSTABLE ROLLER APPLYING MEMBER

(71) Applicant: APR Beauty Group Inc, Toronto (CA)

(72) Inventors: Min-Yan Zheng, Richmond Hill (CA); Feng-Ying Fu, Markham (CA); Jun Shen, Lighthouse Point, FL (US)

(73) Assignee: APR Beauty Group Inc., Richmond Hill (CA)

( * ) Notice: Subject to any disclaimer, the term of this patent is extended or adjusted under 35 U.S.C. 154(b) by 173 days.

(21) Appl. No.: 18/412,543

(22) Filed: Jan. 14, 2024

(65) Prior Publication Data

US 2025/0228350 A1 Jul. 17, 2025

(51) Int. Cl.
*A45D 34/04* (2006.01)

(52) U.S. Cl.
CPC ..... *A45D 34/041* (2013.01); *A45D 2200/10* (2013.01)

(58) Field of Classification Search
CPC .... A45D 34/04; A45D 34/041; A45D 34/043; A45D 34/045; A45D 34/046; A45D 40/26; A45D 40/261; A45D 40/264; A45D 40/265; A45D 40/267; A45D 2200/10; A45D 2200/1009
See application file for complete search history.

(56) References Cited

U.S. PATENT DOCUMENTS

| | | | | |
|---|---|---|---|---|
| 4,165,755 | A | 8/1979 | Cassai | |
| 4,428,388 | A | 1/1984 | Cassai et al. | |
| 6,026,823 | A | 2/2000 | Gueret | |
| 6,811,340 | B2 * | 11/2004 | Petit | A45D 40/265 401/122 |
| 10,292,479 | B2 * | 5/2019 | Thiebaut | A45D 34/04 |
| 2012/0201593 | A1 | 8/2012 | Priore | |
| 2019/0021479 | A1 * | 1/2019 | Sanchez | A45D 33/36 |

* cited by examiner

*Primary Examiner* — Rachel R Steitz
(74) *Attorney, Agent, or Firm* — Jason L DeFrancesco

(57) ABSTRACT

A cosmetic applicator for applying cosmetic products to skin of a user. The cosmetic applicator includes a stem, a cap attached to a proximal end of the stem, a collar connected to a distal end portion of the stem, a swivel connector and a roller applying member. The swivel connector includes a spherical ball at its proximal portion and a shaft at its distal portion. The swivel connector is located at a distal end of the stem and connected to the stem with help of the collar. The roller applying member encloses the distal portion of the swivel connector's shaft and is rotatably connected to the shaft allowing rotation of the roller applying member in both clockwise and anticlockwise directions. The swivel connector enables the adjustment of the roller applying member to various angles relative to the stem's longitudinal axis.

20 Claims, 10 Drawing Sheets

COSMETIC APPLICATOR INCLUDING AN ADJUSTABLE ROLLER APPLYING MEMBER

BACKGROUND

Field

The present disclosure generally relates to an adjustable roller applying member for applying a fluid product.

Description of the Related Art

Conventional cosmetic applicators are designed with a gripping member, a stem, and an applicator element located at one end of the stem. Various patents, such as U.S. Pat. Nos. 6,026,823, 4,165,755, and 4,428,388, and U.S. Pat. Appli. No. 20120201593, describe applicators for cosmetic product application.

Certain cosmetic applicators for makeup or care products have applicator element that have the ability to move relating to the gripping means or the stem. For instance, U.S. Pat. No. 6,026,823, discloses an applicator with a product reservoir, removable cap, and wand, allowing angular movement up to 90°. U.S. Pat. No. 4,165,755 describe applicator with a gripping member, stem, and applicator element, articulated to provide movement.

However, these applicators have limitations in precision, flexibility, and freedom of movement. The disclosure aims to address these issues by providing an ergonomic and adjustable roller applying member that enhances makeup or care application and offers a smooth massage experience. The roller applying member is designed to be flexible, precise, and capable of reaching all parts of the face comfortably. The cosmetic applicator allows for different angles of application for various cosmetic needs, eliminating the inconvenience of carrying multiple implements during travel.

SUMMARY

It is an object of the present disclosure to provide a cosmetic applicator that provide a more user-friendly tool for makeup application, ensuring easy access to all facial areas by allowing for different angles of application. The cosmetic applicator is intended for delicate or tired areas, enabling a light massage.

Accordingly, there is provided a cosmetic applicator equipped with a roller applying member that is rotatable around its own axis and can also be flexibly adjusted to various angles relative to a longitudinal axis of the cosmetic applicator.

According to an aspect of the present disclosure, there is provided a cosmetic package for storing and applying a cosmetic product, equipped with cosmetic applicator of the present disclosure. The cosmetic package comprises a container for holding the cosmetic product and the cosmetic applicator. The cosmetic product can be more viscous than water or, optionally, even pasty, gel, solid or even powder. The cosmetic applicator comprises a cap, a stem, a collar, a swivel connector, and the roller applying member.

According to an aspect of the present disclosure, the cap of the cosmetic applicator has internal threads that can be screwed onto outer threads, formed on a neck of the container. The roller applying member is connected at a distal end of the stem via the collar and the swivel connector. The cap is connected at a proximal end of the stem.

In general, the use of the terms "distal" and "proximal" herein is supposed to mean that the distal is the end facing towards the inside of the container, whereas the proximal is the end facing towards the removal opening of the container.

According to an aspect of the present disclosure, the distal portion of the stem is a stepped-in stem portion that has a diameter less than the rest of the diameter of the stem. A distal surface defined at the end of the stepped-in stem portion is a concave surface.

According to another aspect of the present disclosure, the cosmetic package includes a wiper for wiping off excess product from the cosmetic applicator, the wiper is inserted into the neck of the container.

Specifically, the roller applying member of cosmetic applicator is used to apply the product including a cosmetic or care product. The cosmetic or care product includes viscous cosmetics, mascara, eyebrow powder, lip gloss, hair color, skincare, under-eye cosmetics, pharmaceutical, and like products.

According to yet another aspect of the present disclosure, the roller applying member is connected to the stem through a swivel connector featuring a spherical ball and a shaft, enabling users to pivot the roller applying member to their preferred angle. Additionally, the collar is connected to a distal end of the applicator stem, and this collar serves to secure the swivel connector within a spherical housing created by the concave distal surface of the stem and an interior cavity of the collar. The swivel connector allows the roller applying member to move independently and relative to the stem.

Further, the collar is coupled to the distal end portion of the stem, more particularly to the stepped-in stem portion. The collar may be made of metal, plastic, or any other suitable material. The collar has a cylindrical sidewall, and a distal wall with a distal cutout. In a preferred embodiment, the cylindrical sidewall has an annular groove at inner surface thereof. This annular groove is design to receive an annular protrusion located on the outer surface of the stepped-in stem portion, facilitating coupling of the collar to the stem.

According to yet another aspect of the present disclosure, the distal cutout of the collar is substantially circular. However, in other implementations, the distal cutout may be substantially square-shaped, circular, triangular or of any other suitable shape. The collar secures the swivel connector in the housing of the collar such that the shaft of the swivel connector protrudes through the distal cutout. The swivel connector permits the roller applying member to rotate through a plane defined by the distal cutout in the collar. The cutout defines a range of movement of the swivel connector. Such a ball and socket connection allow rotation of the swivel connector, about a longitudinal axis of the stem, and the rotation may take place in the clockwise or counterclockwise direction. An axis of the swivel connector can be oriented to be inclined with respect to the longitudinal axis of the stem. This is because the swivel connector is maneuverable and can be oriented in relation to the stem. Since, the roller applying member is secured to the shaft of the swivel connector, the roller applying member rotate with swivel connector in the clockwise or counterclockwise direction about the axis of the stem, and oriented away from the longitudinal axis of the stem. The user can modify the angle formed between the longitudinal axis of the stem and the longitudinal axis of the swivel connector to make the swivel connector and the roller applying member off-axis to one side and the other of the axis of the stem.

Additionally, the swivel connector also allows the roller applying member to rotate degrees clockwise or counter-clockwise about the shaft of the swivel connector. This may be desirable for precise application of cosmetic product. Therefore, the roller applying member and the swivel connector are connected in a manner that they are rotatable with respect to each other.

The rotation of the roller applying member with respect to the shaft is about an axis of rotation that is typically coincident with an axis of the shaft of the swivel connector.

In an embodiment of the disclosure, there is cooperation between the roller applying member and the shaft of the swivel connector, wherein the roller applying member forms a "hub", and the shaft of the swivel connector forms a "spindle". The roller applying member collaborates with the shaft while remaining free to rotate with respect to the shaft of the swivel connector.

Advantageously, the roller applying member, forming the hub, comprises a non-through cavity with an opening at a proximal end of the roller applying member.

The roller applying member, according to preferred embodiment has a substantially columnar body with rounded lower end. In other embodiments, the roller applying member may typically be external, cylindrical, tapered, or partially spherical, and will have a typically rounded lower end.

Typically, the roller applying member is connected to the shaft by a click fit or snap fitment means. The snap fitment means includes an annular protrusion formed on outer surface of the shaft and corresponding annular groove formed on an inner surface of the roller applying member.

According to the disclosure, the roller applying member may comprise a means of transferring or temporarily retaining the cosmetic product. This transfer or temporary retention means include flocking. In other embodiments, transfer or temporary retention means include may typically be chosen as either a brush provided with bristles, a cellular foam type material, a fibrous material such as felt or a woven or nonwoven a set of reliefs and recesses such as grooves or ribs formed on the said application means itself.

According to an aspect of the present disclosure, an outer surface of the roller applying member may be flocked with fibers. Briefly, the fibers for flocking which may be of any commonly used material, such as nylon, polyester, or any natural fiber are applied with an adhesive, such as an epoxy, to the surface to be flocked. The flocking finish to the outer surface of the roller applying member may be achieved by an appropriately chosen known technique, such as electrostatic flocking.

According to an alternate embodiment of the present disclosure, the roller applying member may or may not be flocked or partially flocked.

According to yet another aspect of the present disclosure, the roller applying member may include grooves, to provide a satisfactory load of the cosmetic product. In a preferred embodiment, the roller applying member includes two grooves, that make it possible to create product reserves on the application surface. At least one of the two grooves, extend one revolution around a longitudinal axis of the roller applying member. Thus, said least one of the two grooves, is an annular groove. In a preferred embodiment, the edges of the grooves and are mutually parallel.

In the preferred embodiment, the roller applying member includes four faces, namely, a first face, a second face, a third face, and a fourth face. The first face and the third face being opposing faces, and the second face and the fourth face being opposing faces. In this embodiment, both grooves, have a shared edge, with the lower edge of one groove serving as the upper edge of the other groove. Specifically, one groove is an upper groove, while the other groove is a lower groove.

Furthermore, the edges of the grooves and exhibit undulations, featuring a singular trough extending on one face of the roller applying member and a corresponding crest extending on the adjacent surface. Specifically, the edges of each of the two grooves, comprises a first trough on the first face, a first crest on the second face, a second trough on the third face, and a second crest on the fourth face. Consequently, the three troughs are present on the first and third opposing faces of the roller applying member, rendering these faces identical in appearance. Similarly, the three crests are present on the second and fourth opposing faces of the roller applying member, making these faces identical. In this embodiment, each of an upper and lower edge of the groove defines only a single crest or trough extends across the entire width of any given face of the roller applying member. However, in alternative embodiments, more than one crest and/or trough can be present on a single face of the roller applying member.

The at least one groove has a width measured from a lower edge to an upper edge thereof is between 1-3 mm, more particularly 2.7 mm. The length of the roller applying member is between 10-15 mm, more particularly 14 mm. The width of the roller applying member is between 4-7 mm, more particularly 6 mm.

The stem and the cap may be obtained by molding a thermoplastic material chosen from polyolefins, polypropylenes (PP), polyethylene terephthalates (PET) or a high-density polyethylene (HDPE). The thermoplastic material may be introduced into the mould by injection.

In variant embodiments (not shown), the stem and the collar may be secured, for example, a press-fit, snap-fit, adhesive, and/or engagement by one or more engagement features.

The cap can be fastened on the container by snap-fastening or by some other means known in the art.

According to an embodiment of the present disclosure, at least a part of the roller applying member can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

Additional advantages, features, characteristics and aspects of the present invention follow from the claims and the following description of a preferred embodiment with reference to the drawing.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
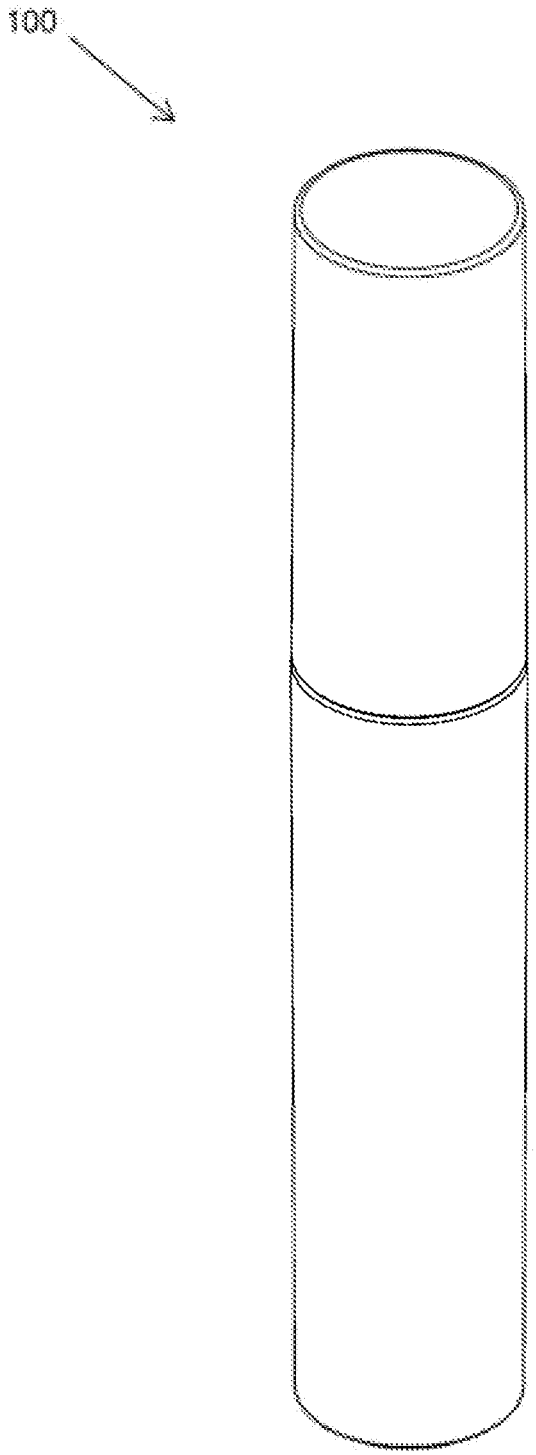
FIG. 1 illustrates a perspective view of a cosmetic package according to a preferred embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered limited by the foregoing description.

The terms "comprise" (and any form of comprise, such as "comprises" and "comprising"), "have" (and any form of have, such as "has" and "having"), "contain" (and any form of contain, such as "contains" and "containing"), and "include" (and any form of include, such as "includes" and "including") are open-ended linking verbs. As a result, a system or method that "comprises," "has," "contains," or "includes" one or more elements possesses those one or more elements, but is not limited to possessing only those one or more elements or steps. Likewise, an element of a system or method that "comprises," "has," "contains," or "includes" one or more features possesses those one or more features, but is not limited to possessing only those one or more features. Furthermore, a structure that is configured in a certain way must be configured in at least that way, but also may be configured in a way or ways that are not specified.

Figure 2:
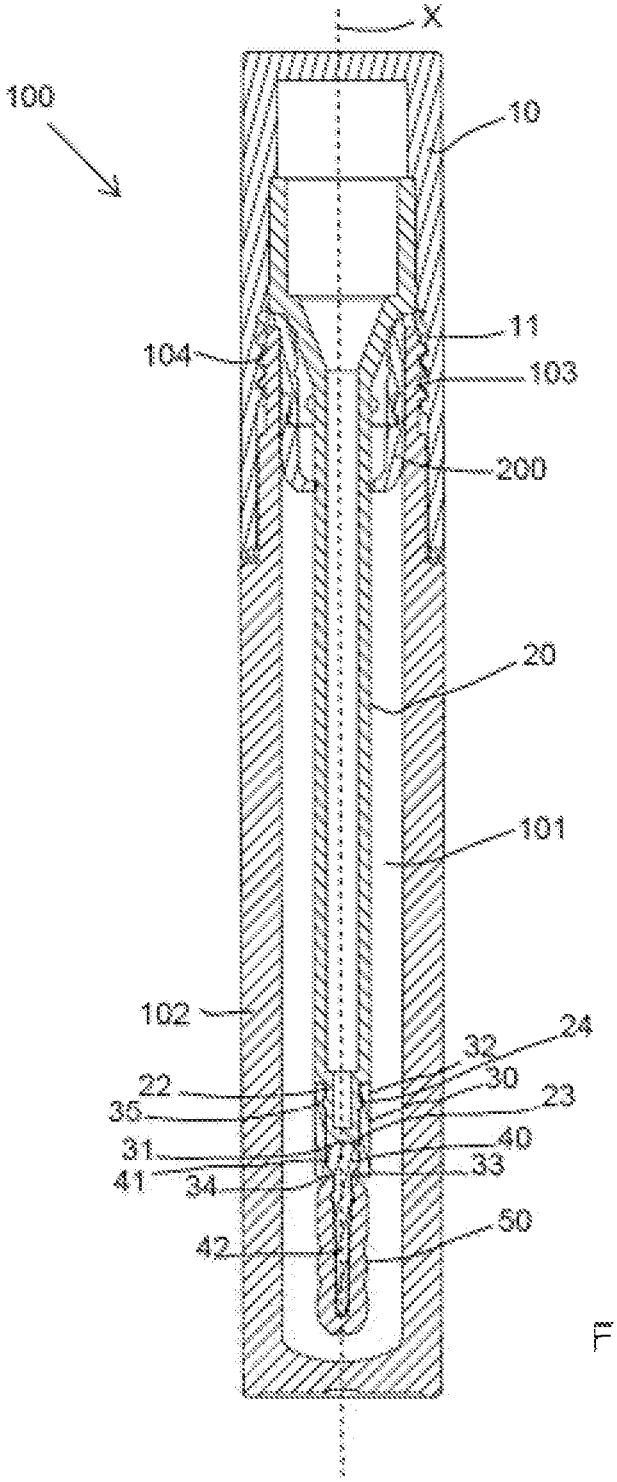
FIG. 2 illustrates a longitudinal cross-sectional view of the cosmetic package of FIG. 1.
Figure 3:
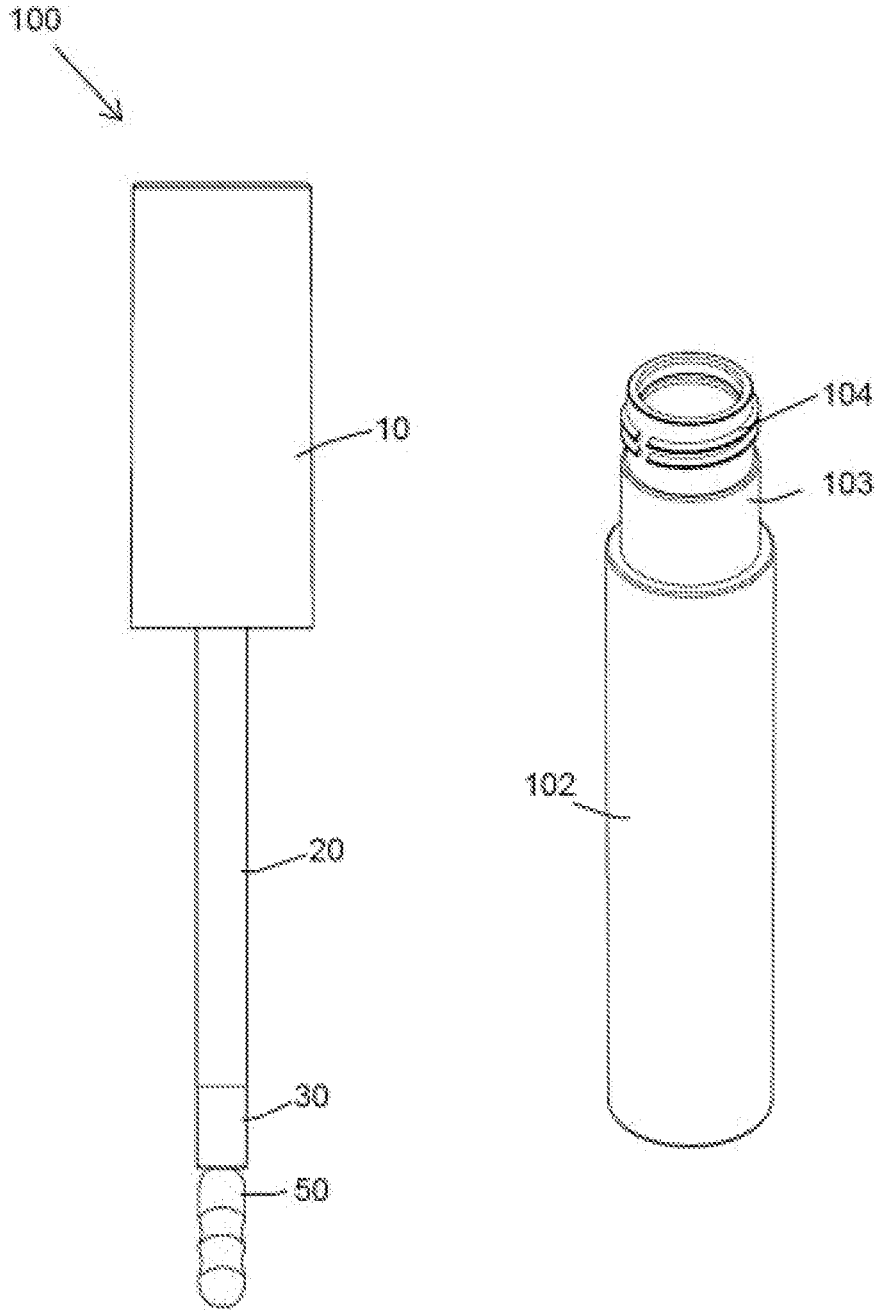
FIG. 3 illustrates a perspective view of the cosmetic package of FIG. 1 with a cosmetic applicator thereof shown in a disengaged position from a container thereof.
Figure 4:
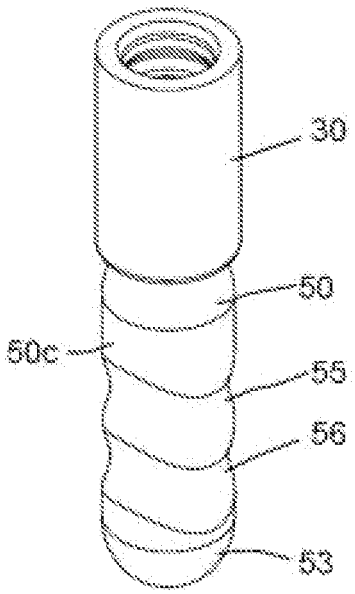
FIG. 4 illustrates a perspective view of an assembly of a collar, a swivel connector and a roller applying member of the applicator of FIG. 3.

FIGS. 1 and 2 show a cosmetic package 100 for storing and applying a cosmetic product, according to a preferred embodiment of the present disclosure. The cosmetic product can be more viscous than water or, optionally, even pasty, gel, solid or even powder.

The cosmetic package 100 comprises a cosmetic applicator 101 equipped with a roller applying member 50 that rotate around its own axis and can also be flexibly adjusted to various angles relative to the longitudinal axis X of the cosmetic applicator 101.

The cosmetic package 100 comprises a container 102 for holding a cosmetic product (not shown) and the cosmetic applicator 101. The cosmetic applicator 101 comprises a cap 10, a stem 20, a collar 30, a swivel connector 40, and the roller applying member 50, see FIG. 2. The cap 10 of the cosmetic applicator 100 has internal threads 11 that can be screwed onto outer threads 104, formed on a neck 103 of the container 102. The roller applying member 50 is connected at a distal end of the stem 20 via the collar 30 and the swivel connector 40. The cap 10 is connected at a proximal end of the stem 20.

In general, the use of the terms "distal" and "proximal" herein is supposed to mean that the distal is the end facing towards the inside of the container 102, whereas the proximal is the end facing towards the removal opening of the container 102.

As seen in FIG. 2, the distal portion of the stem 20 is a stepped-in stem portion 22 that has a diameter less than the rest of the diameter of the stem 20. A distal surface 23 defined at the end of the stepped-in stem portion 22 is a concave surface.

Further, as seen in FIG. 2, the cosmetic package 100 includes a wiper 200 for wiping off excess product from the cosmetic applicator 101, the wiper 200 is inserted into the neck 103 of the container 102.

Further, the roller applying member 50 of cosmetic applicator 101 may be used to apply the product including a cosmetic or care product. The cosmetic or care product includes viscous cosmetics, mascara, eyebrow powder, lip gloss, hair color, skincare, under-eye cosmetics, pharmaceutical, and like products.

The roller applying member 50 is connected to the stem 20 through a swivel connector 40 featuring a spherical ball 41 and a shaft 42, enabling users to pivot the roller applying member 50 to their preferred angle. Additionally, the collar 30 is connected to a distal end of the applicator stem 20, and this collar 30 serves to secure the swivel connector 40 within a spherical housing 31 created by the concave distal surface 23 of the stem 20 and an interior cavity 34 of the collar 30.

Figure 11:
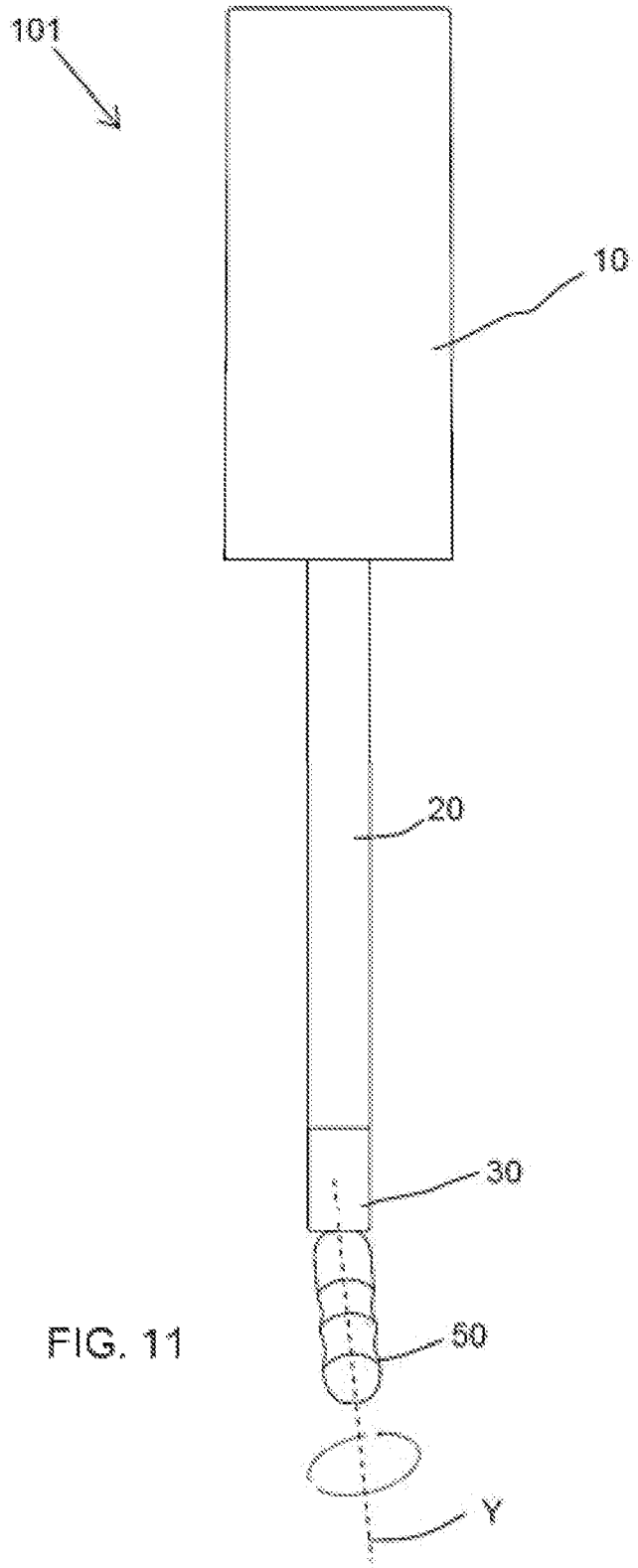
FIG. 11 illustrates a perspective view of the cosmetic applicator of FIG. 3, with a roller applying member thereof shown in deflected state from an axis of a stem of the applicator.

The swivel connector 40 allows the roller applying member 50 to move independently and relative to the stem 20, see FIG. 11.

In preferred embodiment, as shown in FIG. 2, the collar 30 is coupled to the distal end portion of the stem 20, more particularly to the stepped-in stem portion 22. The collar 30 may be made of metal, plastic, or any other suitable material. Referring to FIGS. 2 and 5, 10, and 12, the collar 30 has a cylindrical sidewall 32, and a distal wall 34 with a distal cutout 33. In the current embodiment, the cylindrical sidewall 32 has an annular groove 35 at inner surface thereof. Referring to FIG. 2, this annular groove 35 is design to receive an annular protrusion 24 located on the outer surface of the stepped-in stem portion 22, facilitating coupling of the collar 30 to the stem 20.

Figure 12:
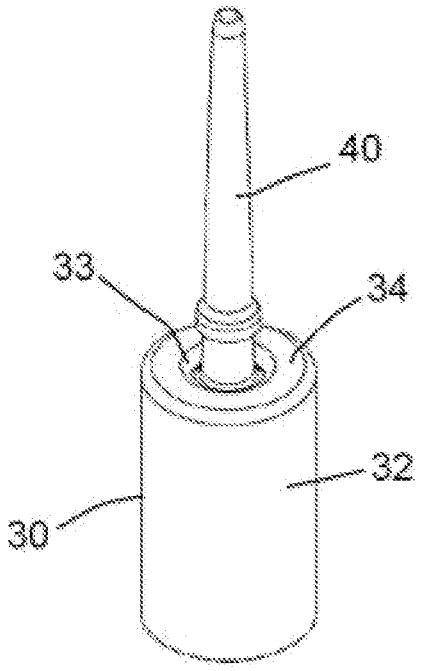
FIG. 12 illustrates a perspective view of a collar engaged with a swivel connector of the cosmetic applicator of FIG. 3.
Figure 13:
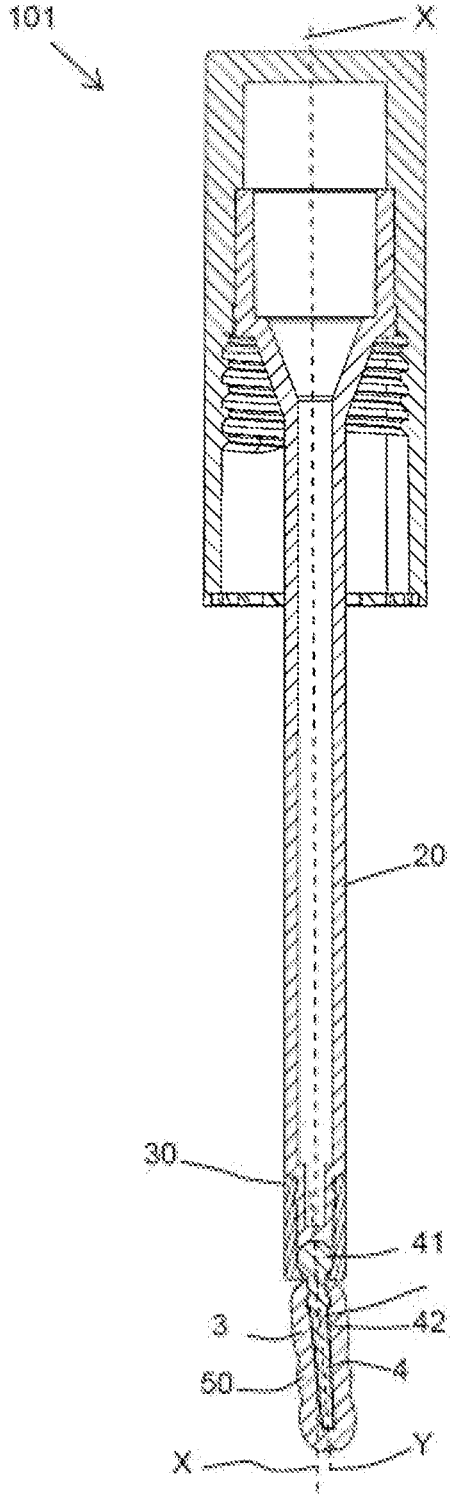
FIG. 13 illustrates a longitudinal cross-section of the cosmetic applicator of FIG. 11.

The distal cutout 33 depicted in FIGS. 2 and 12 is substantially circular. However, in other implementations, the distal cutout 33 may be substantially square-shaped, circular, triangular or of any other suitable shape. A seen in FIGS. 10 and 2, the collar 30 secures the swivel connector 40 in the housing 31 of the collar 30 such that the shaft 42 of the swivel connector 40 protrudes through the distal cutout 33. The swivel connector 40 permits the roller applying member 50 to rotate through a plane defined by the distal cutout 33 in the collar 30. The cutout 33 defines a range of movement of the swivel connector 40. Such a ball and socket connection allow rotation of the swivel connector 40, about an axis X of the stem 20, and the rotation may take place in the clockwise or counterclockwise direction. An axis Y of the swivel connector 40 can be oriented to be inclined with respect to the axis X of the stem 20, see FIG. 11. This is because the swivel connector 40 is maneuverable and can be oriented in relation to the stem 6. Since, the roller applying member 50 is secured to the shaft 42 of the swivel connector 40, the roller applying member 50 rotate with swivel connector 40 in the clockwise or counterclockwise direction about the axis X, and oriented away from the axis X of the stem 20. The user can modify the angle formed between the axis X of the stem 20 and the axis Y of the swivel connector 40 to make the swivel connector 40 and the roller applying member 50 off-axis to one side and the other of the axis X of the stem 20, see FIG. 13.

Additionally, the swivel connector 40 also allows the roller applying member 50 to rotate 360 degrees clockwise or counterclockwise about the axis Y with respect to the shaft 42 of the swivel connector 40. This may be desirable for precise application of cosmetic product. Therefore, the roller applying member 50 and the swivel connector 40 are connected in a manner that they are rotatable with respect to each other.

The rotation of the roller applying member 50 with respect to the shaft 42 is about an axis of rotation Y that is typically coincident with an axial direction Y of the shaft 42.

In an embodiment of the disclosure, there is cooperation between the roller applying member 50 and the shaft 42, wherein the roller applying member 50 forms a "hub" 3, and the shaft 42 forms a "spindle" 4. The roller applying member 50 collaborates with the shaft 42 while remaining free to rotate with respect to the shaft 42.

Advantageously, the roller applying member 50, forming the hub 3, comprises a non-through cavity 51 with an opening 52 (see FIG. 10) at a proximal end of the roller applying member 50.

Referring to FIGS. 4-9, the roller applying member 50 is shown as having a substantially columnar body 53 with rounded lower end. In the present embodiment, the roller applying member 50 has a cylindrical body with a rounded lower end. In other embodiments, the roller applying member 50 may typically be external, cylindrical, tapered, or partially spherical, and will have a typically rounded lower end.

Figure 5:
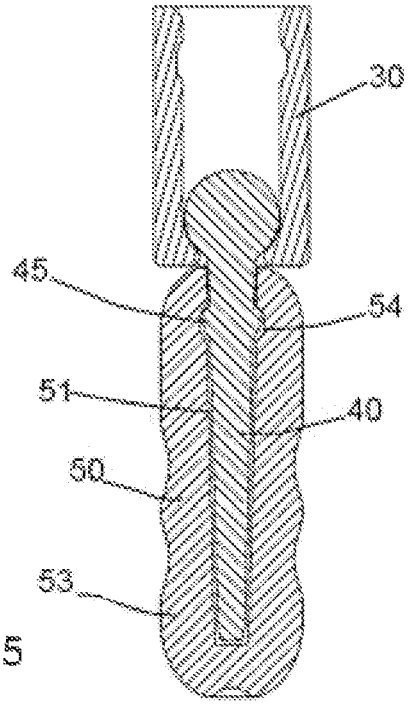
FIG. 5 illustrates a longitudinal cross-sectional view of assembly of a collar, a swivel connector and a roller applying member of FIG. 4.
Figure 6:
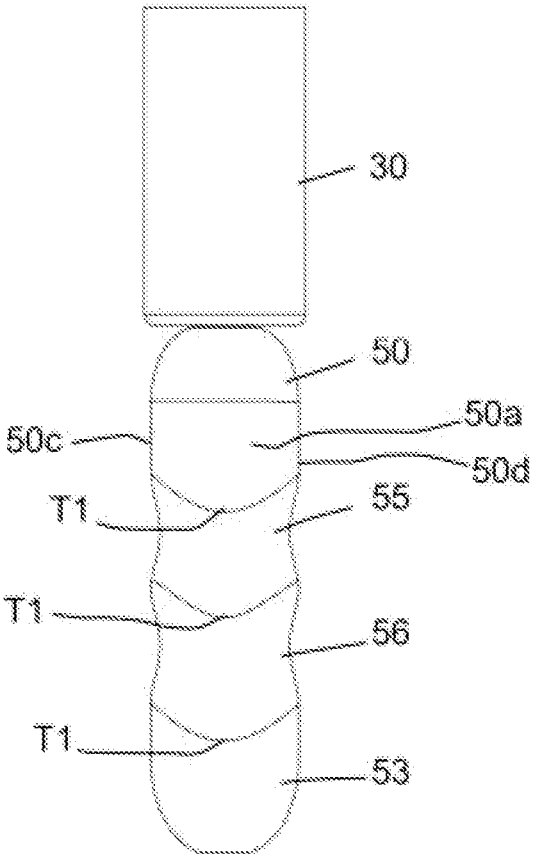
FIG. 6 illustrates a front side view of assembly of a collar, a swivel connector and a roller applying member of FIG. 4.
Figure 7:
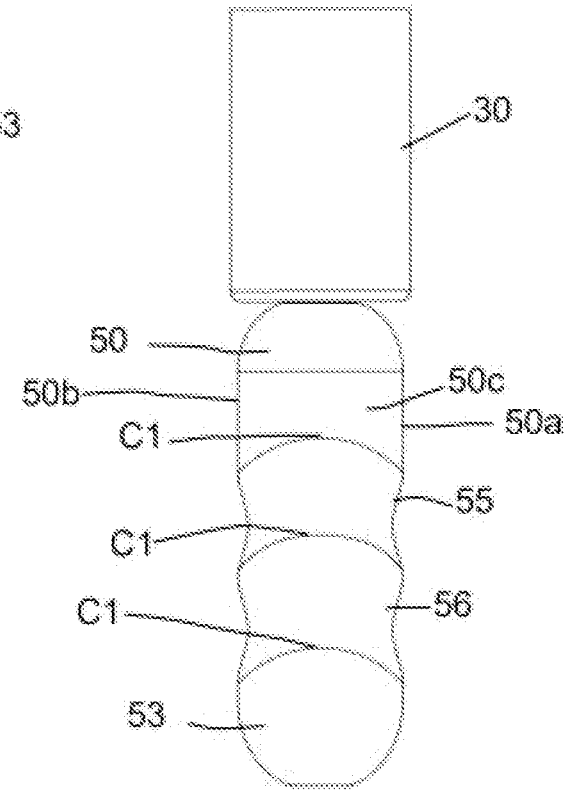
FIG. 7 illustrates a side view of the assembly of a collar, a swivel connector and a roller applying member of FIG. 4.
Figure 8:
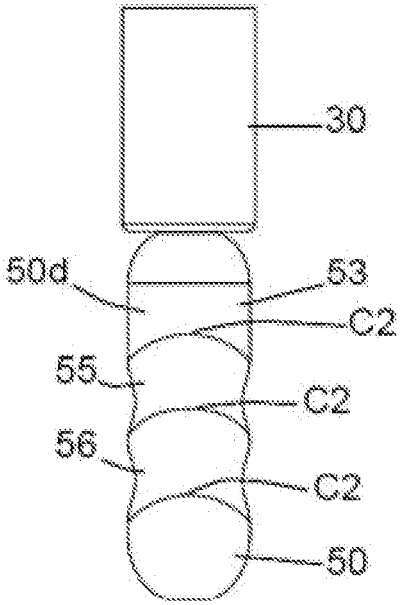
FIG. 8 illustrates a right side view of assembly of a collar, a swivel connector and a roller applying member of FIG. 4.
Figure 9:
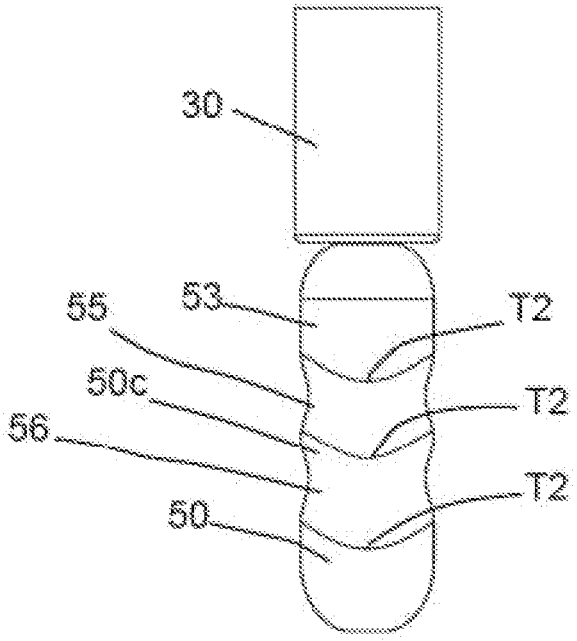
FIG. 9 illustrates a back side view of the assembly of a collar, a swivel connector and a roller applying member of FIG. 4.
Figure 10:
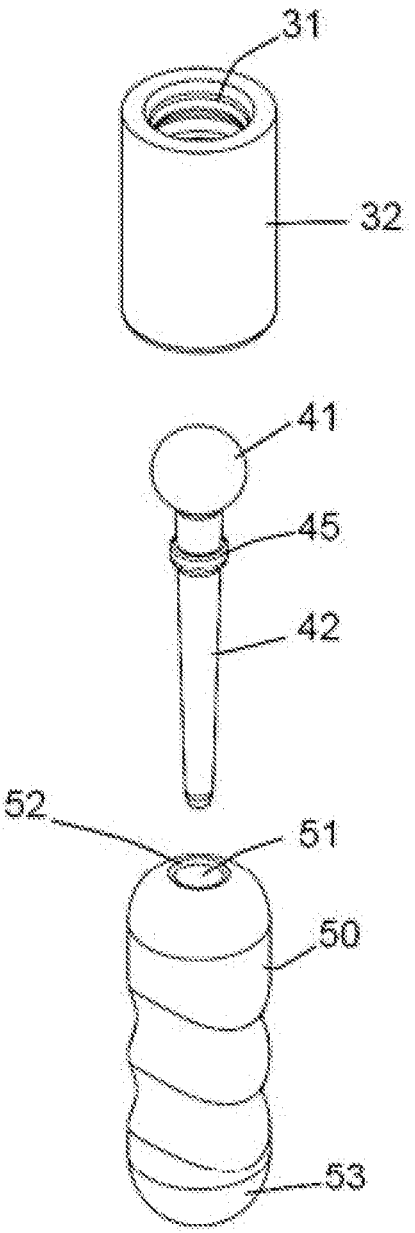
FIG. 10 illustrates an exploded view of the assembly of a collar, a swivel connector and a roller applying member of FIG. 4.

Referring to FIGS. 5 and 10, typically, the roller applying member 50 is connected to the shaft 42 by a click fit or snap fitment means (54, 45). The snap fitment means includes an annular protrusion 45 formed on outer surface of the shaft 42 and corresponding annular groove 54 formed on an inner surface of the roller applying member 50.

According to the disclosure, the roller applying member 50 may comprise a means of transferring or temporarily retaining the cosmetic product. This transfer or temporary retention means include flocking 60. In other embodiments, transfer or temporary retention means include may typically be chosen as either a brush provided with bristles, a cellular foam type material, a fibrous material such as felt or a woven or nonwoven a set of reliefs and recesses such as grooves or ribs formed on the said application means itself.

Figure 14:
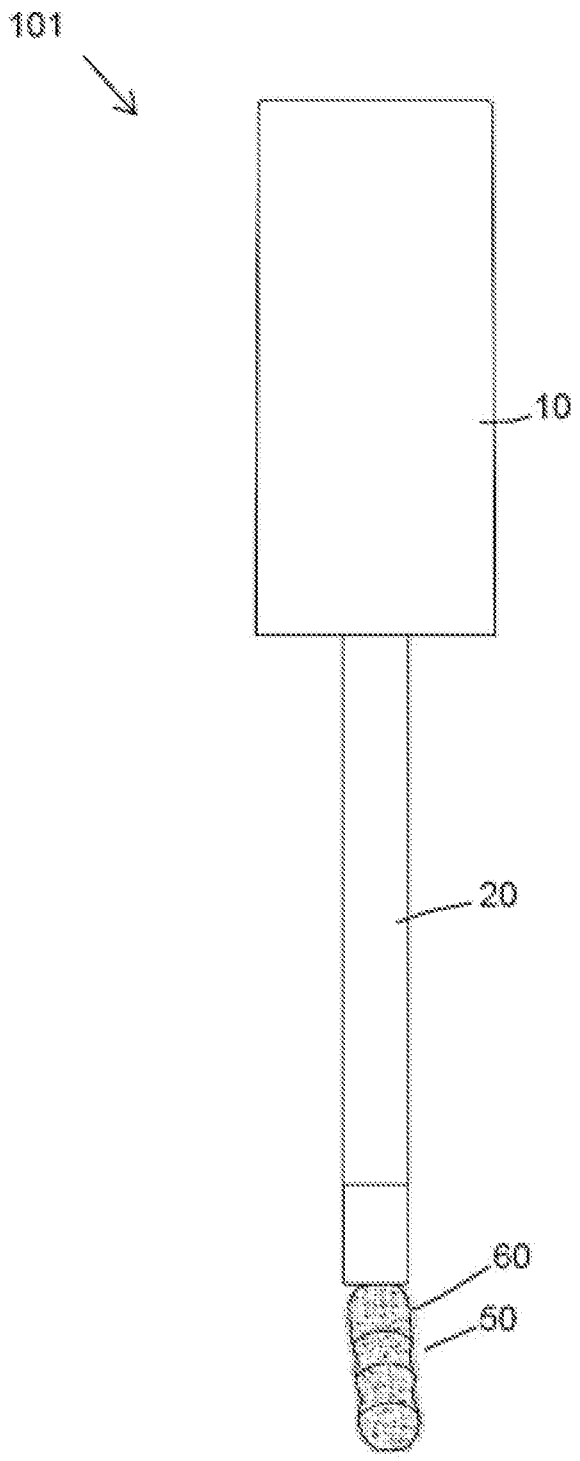
FIG. 14 illustrates a perspective view of the cosmetic applicator of FIG. 11; with a roller applying member thereof flocked with fibers.

According to an aspect of the present disclosure, an outer surface of the roller applying member 50 may be flocked with fibers 60, as seen in FIG. 14. Briefly, the fibers 60 for flocking which may be of any commonly used material, such as nylon, polyester, or any natural fiber are applied with an adhesive, such as an epoxy, to the surface to be flocked. The flocking finish to the outer surface of the roller applying member 50 may be achieved by an appropriately chosen known technique, such as electrostatic flocking.

According to an alternate embodiment of the present disclosure, the roller applying member 50 may or may not be flocked or partially flocked.

As seen in FIGS. 4, 6, 7, 8, and 9, the roller applying member 50 may include grooves 55, 56 to provide a satisfactory load of the cosmetic product. In the present embodiment, the roller applying member 50 includes two grooves 55, 56 that make it possible to create product reserves on the application surface.

As shown in FIGS. 4, and 6-9, the at least one of the two grooves 55, 56 extend one revolution around a longitudinal axis of the roller applying member 50. Thus, the least one of the two grooves 55, 56 is an annular groove. In this embodiment, the edges of the grooves 55 and 56 are mutually parallel.

In the present embodiment, the roller applying member 50 includes four faces, namely, a first face 50*a*, a second face 50*b*, a third face 50*c* and a fourth face 50*d*. The first face 50*a* and the third face 50*c* being opposing faces, and the second face 50*b* and the fourth face 50*d* being opposing faces.

In this embodiment, both grooves 55 and 56 have a shared edge, with the lower edge of the groove 55 serving as the upper edge of the groove 56. Specifically, groove 55 is an upper groove, while groove 56 is a lower groove.

The edges of the grooves 55 and 56 exhibit undulations, featuring a singular trough, T1, extending on one face of the roller applying member 50 and a corresponding crest C1 extending on the adjacent surface. Specifically, each of an upper edge and a lower edge of the two grooves 55, 56 comprises a first trough T1 on the first face 50*a*, a first crest C1 on the second face 50*b*, a second trough T2 on the third face 50*c*, and a second crest C2 on the fourth face 50*d*, refer FIGS. 6-9. Consequently, the three troughs are present on each of the opposing faces 50*a* and 50*c* of the roller applying member 50, rendering these faces 50*a* and 50*c* identical in appearance. Similarly, the three crests are present on each of the opposing faces 50*b* and 50*d* of the roller applying member 50, making these faces 50*b* and 50*d* identical. In this embodiment, only a single crest or trough extends across the entire width of any given face of the roller applying member 50. However, in alternative embodiments, more than one crest and/or trough can be present on a single face of the roller applying member 50.

The at least one groove 55, 56 has a width, measured a shortest distance from a lower edge to an upper edge thereof, between 1-3 mm, more particularly 2.7 mm. A length of the roller applying member 50 is between 10-15 mm, more particularly 14 mm. The length of the roller applying member 50 is measured along the axis X of the applicator 101. A maximum width of the roller applying member 50 is between 4-7 mm, more particularly 6 mm. The width of the roller applying member 50 is measured perpendicularly to the length direction of the roller applying member 50.

The stem 20 and the cap 10 may be obtained by molding a thermoplastic material chosen from polyolefins, polypropylenes (PP), polyethylene terephthalates (PET) or a high-density polyethylene (HDPE). The thermoplastic material may be introduced into the mould by injection.

In variant embodiments (not shown), the stem 20 and the collar 30 may be secured, for example, a press-fit, snap-fit, adhesive, and/or engagement by one or more engagement features.

The cap 10 can be fastened on the container 102 by snap-fastening or by some other means known in the art.

According to an embodiment of the present disclosure, at least a part of the roller applying member 50 can be made by molding, e.g. by injection-molding, e.g. in a material selected from the following list: thermoplastic materials; elastomers; thermoplastic elastomers; thermoplastic elastomer polyester such as HYTREL®, nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the invention. In addition, those skilled in the art may readily change or modifications to the disclosed embodiments, based on the present specification, such changes or modifications also belong to the scope of the present disclosure will be apparent.

What is claimed is:

1. A cosmetic applicator for applying a cosmetic product, comprising:

a stem having a proximal end and a closed distal end;

a cap attached to a proximal end of the stem;

a collar connected to an outer peripheral surface of a distal end portion of the stem;

a swivel connector comprising a spherical ball at a proximal portion thereof and a shaft at a distal portion thereof;

a roller applying member enclosing a distal portion of the shaft of the swivel connector, the roller applying member being rotatable with respect to the shaft of the swivel connector in both clockwise and anticlockwise directions;

wherein the swivel connector enabling adjustment of the roller applying member to various angles relative to a longitudinal axis of the stem;

wherein the swivel connector is secured within a housing created jointly by a concave distal surface of the stem forming an upper wall of the housing and the collar with an interior cavity forming a surrounding wall of the housing;

wherein the roller applying member includes at least two grooves, each of at least two grooves extending one revolution around a longitudinal axis of the roller applying member; and wherein each of an upper edge and a lower edge one of the at least two grooves being wavy, with a single trough on one face of the roller applying member and a single crest on an adjacent face of the roller applying member.

2. The cosmetic applicator of claim 1, wherein the distal portion of the stem comprising a stepped-in stem portion with a diameter less than the rest of the diameter of the stem and a concave surface defined at the end of the stepped-in stem portion.

3. The cosmetic applicator of claim 1, wherein at least a portion of an outer surface of the roller applying member is flocked with fibers.

4. The cosmetic applicator of claim 1, wherein the collar has a cylindrical sidewall, and a distal wall with a distal cutout; wherein the distal cutout of the collar is circular; wherein the collar secures the swivel connector in the housing of the collar such that the shaft of the swivel connector protrudes through the distal cutout and the spherical ball is retained within the housing; and wherein the swivel connector permits the roller applying member to rotate through a plane defined by the distal cutout in the collar.

5. The cosmetic applicator of claim 4, wherein the cylindrical sidewall of the collar has an annular groove at inner surface thereof; wherein the annular groove is design to receive an annular protrusion located on the outer surface of the stem, for coupling of the collar to the stem.

6. The cosmetic applicator of claim 1, wherein the roller applying member has a columnar body with a closed rounded lower end and a non-through cavity with an opening at a proximal end thereof.

7. The cosmetic applicator of claim 1, wherein the roller applying member is connected to the shaft of the swivel connector by a snap fitment means; and wherein the snap fitment means includes an annular protrusion formed on outer surface of the shaft of the swivel connector and corresponding annular groove formed on an inner surface of the roller applying member.

8. The cosmetic applicator of claim 1, wherein the roller applying member includes a first face, a second face, a third face, and a fourth face; wherein the first face and the third face are opposing faces, and the second face and the fourth face are opposing faces.

9. The cosmetic applicator of claim 8, wherein the upper edge and the lower edge of each of the at least two grooves, comprises a first trough on the first face, a first crest on the second face, a second trough on the third face, and a second crest on the fourth face.

10. The cosmetic applicator of claim 1, wherein the at least two grooves, have a shared edge, with the lower edge of one groove of the at least two grooves serving as the upper edge of the other groove of the at least two grooves.

11. The cosmetic applicator of claim 1, wherein at least one groove of the at least two grooves has a width, measured from the lower edge to the upper edge thereof, between 1-3 mm.

12. The cosmetic applicator of claim 1, wherein the length of the roller applying member is between 10-15 mm; and wherein the width of the roller applying member is between 4-6 mm.

13. The cosmetic applicator of claim 1, wherein the cosmetic applicator is configured to be part of a cosmetic package; wherein the cosmetic package comprises a container for holding the cosmetic product and the cosmetic applicator; wherein the cap of the cosmetic applicator has internal threads that can be screwed onto outer threads formed on a neck of the container; and wherein the cosmetic package includes a wiper for wiping off excess product from the cosmetic applicator, the wiper is inserted into the neck of the container.

14. A cosmetic applicator for applying a cosmetic product, comprising:

a stem having a proximal end and a closed distal end;

a cap attached to a proximal end of the stem;

a collar connected to an outer peripheral surface of a distal end portion of the stem;

a swivel connector comprising a spherical ball at a proximal portion thereof and a shaft at a distal portion thereof;

a roller applying member enclosing a distal portion of the shaft of the swivel connector and being rotatable with respect to the shaft of the swivel connector in both clockwise and anticlockwise directions;

wherein the swivel connector enabling pivoting of the roller applying member to various angles relative to a longitudinal axis of the stem;

wherein the swivel connector is located at a distal end of the stem and connected to the stem with help of the collar;

wherein the roller applying member has a columnar body with a closed rounded lower end and a non-through cavity with an opening at a proximal end thereof, and wherein at least a portion of an outer surface of the roller applying member is flocked with fibers.

15. The cosmetic applicator of claim 14, wherein the roller applying member includes at least two grooves, each of at least two grooves extending one revolution around a longitudinal axis of the roller applying member; and wherein each of an upper edge and a lower edge one of the at least two grooves being wavy, with a single trough on one face of the roller applying member and a single crest on an adjacent face of the roller applying member.

16. The cosmetic applicator of claim 15, wherein the roller applying member includes a first face, a second face, a third face, and a fourth face; wherein the first face and the third face are opposing faces, and the second face and the fourth face are opposing faces.

17. The cosmetic applicator of claim 16, wherein the upper edge and the lower edge of each of the at least two grooves, comprises a first trough on the first face, a first crest on the second face, a second trough on the third face, and a second crest on the fourth face.

18. The cosmetic applicator of claim 14, wherein the swivel connector is secured within a spherical housing created by a concave distal surface of the stem and an interior cavity of the collar.

19. A cosmetic applicator for applying a cosmetic product, comprising:

a stem having a proximal end and a closed distal end;

a cap attached to a proximal end of the stem;

a collar connected to an outer peripheral surface of a distal end portion of the stem;

a swivel connector comprising a spherical ball at a proximal portion thereof and a shaft at a distal portion thereof, a roller applying member enclosing a distal portion of the shaft of the swivel connector and being rotatable with respect to the shaft of the swivel connector in both clockwise and anticlockwise directions;

wherein the swivel connector enabling adjustment of the roller applying member to various angles relative to a longitudinal axis of the stem; and wherein the swivel connector is secured within a housing created by a concave distal surface of the stem forming an upper wall of the housing and the collar with an interior cavity forming a surrounding wall of the housing.

20. The cosmetic applicator of claim 19, wherein the roller applying member includes at least two grooves, each of at least two grooves extending one revolution around a longitudinal axis of the roller applying member; and wherein each of an upper edge and a lower edge one of the at least two grooves being wavy, with a single trough on one face of the roller applying member and a single crest on an adjacent face of the roller applying member.

* * * * *